US012796761B2

(12) United States Patent
Engel

(10) Patent No.: US 12,796,761 B2
(45) Date of Patent: Nov. 17, 2026

(54) IDENTIFICATION-STORING HEADGEAR

(71) Applicant: Engel Enterprises LLC, Yukon, OK (US)

(72) Inventor: Peter Engel, Yukon, OK (US)

(73) Assignee: Engel Enterprises LLC, Yukon, OK (US)

( * ) Notice: Subject to any disclaimer, the term of this patent is extended or adjusted under 35 U.S.C. 154(b) by 0 days.

(21) Appl. No.: 19/298,895

(22) Filed: Aug. 13, 2025

(65) Prior Publication Data

US 2026/0108004 A1 Apr. 23, 2026

Related U.S. Application Data

(60) Provisional application No. 63/682,419, filed on Aug. 13, 2024.

(51) Int. Cl.
*A42B 1/241* (2021.01)
*A42B 1/248* (2021.01)

(52) U.S. Cl.
CPC ..... *A42B 1/241* (2013.01); *A42B 1/248* (2013.01)

(58) Field of Classification Search
CPC ..... A42B 1/241; A42B 1/248; A42B 1/004
USPC ..... 2/244, 209.13, 250
See application file for complete search history.

(56) References Cited

U.S. PATENT DOCUMENTS 792,533 A * 6/1905 Miller ..... A42B 1/248 40/329
2,577,717 A * 12/1951 Stevens ..... A42B 1/248 40/329
2,803,829 A * 8/1957 Tscharner ..... A42B 1/248 D2/866
4,236,559 A * 12/1980 Archbold ..... A45C 3/00 190/902
4,924,613 A * 5/1990 Levin ..... G09F 21/02 40/586
5,233,703 A * 8/1993 Galka ..... A42B 1/248 2/10
5,276,985 A * 1/1994 Halloran ..... A42B 1/248 40/586
5,452,479 A * 9/1995 Mostert ..... A42B 1/248 40/329

(Continued)

OTHER PUBLICATIONS

Seton Website; Hard Hatt Badge Holder; https://www.seton.com/hard-hat-badge-holder-90812.html.

(Continued)

*Primary Examiner* — Jameson D Collier
(74) *Attorney, Agent, or Firm* — Silverline Legal, PLLC; Tynla A. McQuigg

(57) ABSTRACT

An identification-storing headgear is designed with an identification holder for storing a wearer's ID card. In one aspect, the headgear is disclosed having a crown with an inner surface and a sweatband secured to the inner surface. The crown also has an identification slit and an identification viewing aperture. The identification holder is positioned behind the identification viewing aperture between the inner surface and the sweatband. A front portion of the identification holder is positioned against the inner surface of the crown, and a back portion of the identification holder is secured to the front portion to form an identification compartment, which opens at the identification slit of the crown.

28 Claims, 6 Drawing Sheets

(56) References Cited

U.S. PATENT DOCUMENTS 5,465,426 A * 11/1995 Beaton ..... A42B 1/248 40/329
5,548,847 A 8/1996 Spicijaric
5,581,813 A * 12/1996 Henschel ..... A42B 1/248 40/329
5,704,067 A * 1/1998 Brady ..... G09F 3/005 273/DIG. 26
5,800,900 A * 9/1998 Mitchell ..... A43B 1/0054 2/244
5,953,757 A * 9/1999 Blanks, I ..... G09F 21/02 2/243.1
D417,063 S * 11/1999 Henning ..... D2/866
6,085,449 A 7/2000 Tsui
6,154,992 A * 12/2000 Lee ..... G09F 3/20 40/329
6,240,568 B1 * 6/2001 Lee ..... A41D 27/08 40/329
6,311,332 B1 * 11/2001 Lien ..... A42B 1/248 40/329
6,651,368 B1 * 11/2003 Blanks, I ..... A47G 19/2227 40/765
6,729,058 B2 5/2004 Ferguson
6,751,805 B1 * 6/2004 Austion ..... A41D 27/08 2/94
7,093,305 B2 * 8/2006 Reilly ..... A42B 3/0406 2/209.13
8,453,265 B2 * 6/2013 Forte ..... G09F 21/02 40/586
10,522,058 B2 12/2019 Passman
D876,755 S * 3/2020 Gonzalez ..... D2/866
11,241,057 B2 2/2022 Bloniarz
2006/0026739 A1 2/2006 Kronenber
2010/0299979 A1 * 12/2010 LaMere ..... G09F 21/02 40/329
2011/0094014 A1 * 4/2011 Chang ..... A42B 1/248 2/175.1
2014/0338099 A1 * 11/2014 Marscellas ..... A42B 1/012 2/209.13
2016/0351081 A1 * 12/2016 Willoughby ..... A45C 11/00

OTHER PUBLICATIONS

Safe-Card ID on Amazon; Hard Hat ID Badge Holder; https://www.amazon.com/Safe-Card-Hard-Hat-Badge-Holder/dp/B005JT19H0.
Sayre Website; Hat Back w/ ID Holder; https://www.sayreinc.com/Hat-Block-ID-Holder-p/lt000605p.htm.

* cited by examiner

IDENTIFICATION-STORING HEADGEAR

CROSS REFERENCE TO RELATED APPLICATIONS

This application claims the benefit of U.S. Provisional Application No. 63/682,419 filed on Aug. 13, 2024, which is incorporated by reference in this document as if fully set out herein in its entirety

FIELD OF THE INVENTION

This invention relates generally to headgear, and more particularly to an identification-storing headgear having an identification holder.

BACKGROUND OF THE INVENTION

Identification cards and badges (collectively, "ID cards" or "IDs") have been increasingly implemented in workplaces, on university campuses, and in conference settings. These ID cards are used to enhance security, identify personnel, and foster professionalism by displaying branding or the wearer's personal details (e.g., name, photo, job title, etc.). IDs may also be used to provide accountability and improve efficiency for processes such as automated time and attendance entry, while helping to reduce errors with the same.

To accomplish the foregoing, ID cards may be equipped with a communication system that enables contactless information exchange. Systems such as radio-frequency identification (RFID) systems or near field communication (NFC) systems can be used to exchange data between the ID card and an ID reader. For example, RFID-enabled ID cards contain an embedded RFID chip and antenna that emit radio signals. RFID readers emit radio waves that power the RFID chip, thereby allowing the chip to provide encoded information to the RFID reader. Similarly, NFC chips communicate with NFC readers to verify ID information. Other suitable communication systems in IDs include barcodes, machine-readable zone (MRZ) codes, and optical character recognition (OCR). The information provided by an ID card to a corresponding reader may be used, for example, to dictate access to secure areas within a workplace. In such instances, the information received by the RFID reader will be processed and result either in grant or denial of access.

The importance of ID cards for information exchange—contactless or otherwise—has made access to one's ID a common necessity. Based on their thin profile, ID cards are easily lost. The loss of an ID can compromise security, delay information transfer, and prevent the owner's access to necessary resources. Depending on the type of ID and whether it incorporates contactless functionality, replacing a lost ID card can also be both costly and inconvenient.

To alleviate these concerns, several systems have been developed to prevent loss of one's ID and facilitate easy access for contactless information exchange. For example, an ID may be disposed within a clear, vinyl holder and worn in a lanyard around the owner's neck. These lanyards are not suitable for environments where the lanyard may become caught on equipment and thereby present a safety hazard. Some individuals also find lanyards to be cumbersome to wear. For individuals who are not in the habit of wearing lanyards, it may also be difficult to remember to don the lanyard when leaving one's home, workplace, etc.

Arm bands have also been developed to hold an ID card against a wearer's arm for easy access. One issue with this solution is that arm bands can loosen. As such, arm bands require adjustment to ensure that they do not fall or disengage from the wearer's arm. Elastic-based arm bands may also be worn out quickly with use and may require frequent replacement.

Although these prior art designs have taken steps in improving ID card access and loss-prevention, there remain opportunities to optimize the storage and transport of IDs. It is to these and other deficiencies in the prior art that the present embodiments are directed.

Before proceeding to a detailed description of the invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

SUMMARY OF THE INVENTION

In some embodiments, the present disclosure is directed to an identification-storing headgear that includes a crown, which has an inner surface and an identification slit, and an identification holder. The identification holder includes a front portion positioned against the inner surface of the crown and a back portion that is secured to the front portion. The front and back portions form an identification compartment that opens at the identification slit of the crown.

In other embodiments, a headgear is disclosed having a crown and an identification holder. The crown includes an inner surface, an identification slit, and an identification viewing aperture, behind which the identification holder is positioned. The identification holder includes a front portion positioned against the inner surface of the crown and a back portion that is secured to the front portion to form an identification compartment. The identification compartment opens at the identification slit of the crown.

In yet other embodiments, a headgear is disclosed having a crown and an identification holder. The crown includes an inner surface and a sweatband secured to the inner surface. The crown also has an identification slit and an identification viewing aperture. The identification holder is positioned behind the identification viewing aperture between the inner surface and the sweatband. A front portion of the identification holder is positioned against the inner surface of the crown, and a back portion of the identification holder is secured to the front portion to form an identification compartment, which opens at the identification slit of the crown.

BRIEF DESCRIPTION OF DRAWINGS

The accompanying drawings, which are incorporated in and constitute part of this specification, illustrate embodiments of the invention and together with the description, explain the principles of the disclosed embodiments, it being understood, however, that the invention is not limited to the precise arrangements and instrumentalities shown.

DETAILED DESCRIPTION

Figure 1A:
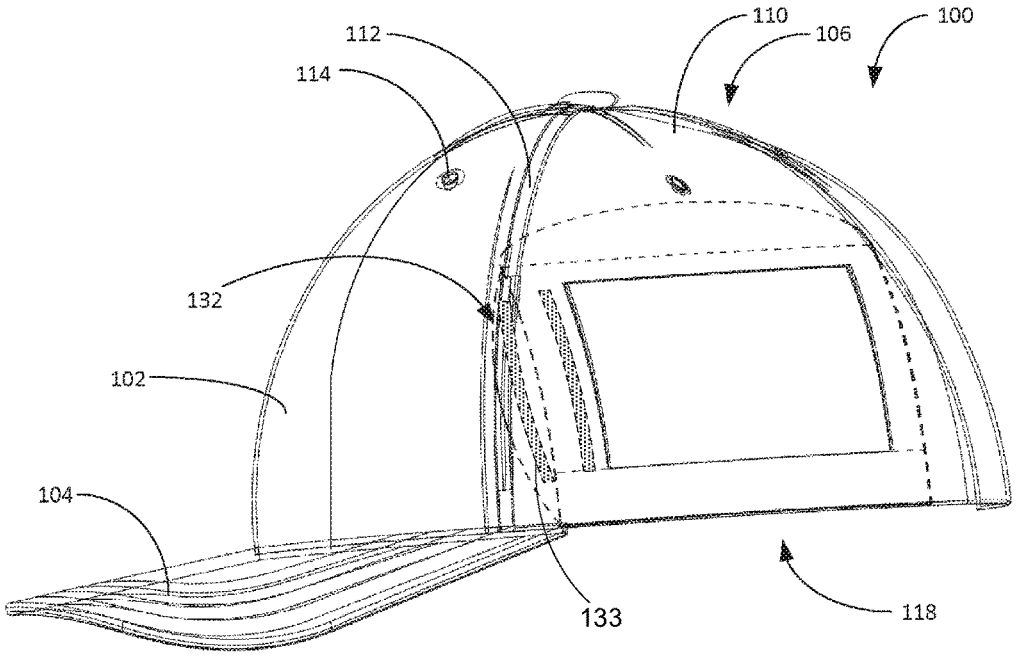
FIG. 1A presents a partial cutaway perspective view of an identification-storing headgear constructed in accordance with an exemplary embodiment.

This disclosure, its applications, and implementations are not limited to the specific headgear or material types, or other system component examples, or methods disclosed herein. Many additional components, manufacturing and assembly procedures known in the art consistent with headgear manufacture are contemplated for use with particular implementations from this disclosure. Accordingly, for example, although particular headgears are disclosed, such headgears and implementing components may be configured in any shape, size, style, type, model, version, measurement, material, and/or the like as is known in the art, consistent with the intended operation of a headgear for storing an individual's identification card ("ID card" or "ID").

While this disclosure includes a number of embodiments in many different forms, there is shown in the drawings and will herein be described in detail, particular embodiments with the understanding that the present disclosure is to be considered as an exemplification of the principles of the disclosed methods and systems and is not intended to limit the broad aspect of the disclosed concepts to the embodiments illustrated.

Referring now to the figures of the drawings, wherein like numerals of reference designate like elements throughout the several views, and in spatial reference to a user ("wearer") of the invention, FIGS. 1 through 4 depict an identification-storing headgear 100 having a crown 102 and a visor 104 attached to the crown 102. As used herein, the term "crown" is understood to refer to the portion of the headgear 100 that sits on or against the wearer's head. Although the figures generally depict the headgear 100 as a baseball cap, it will be appreciated that the headgear 100 may be a cap with a different style or other types of headwear, including without limitation beanies, bucket hats, cowboy hats, fedoras, helmets (e.g., for construction, biking, motorcycling, safety, sports, welding, etc.), and headbands. Suitable materials for the headgear 100 include fabrics (e.g., cotton, rayon, polyester, wool, acrylic, blends of one or more of the same, etc.), thermoplastics, fire resistant materials, and composite fiber materials. For example, FIG. 5 depicts an embodiment where the headgear 100 is a beanie. It is intended that the headgear 100 will be as easy to use put on and take off as any standard hat, cap, or helmet.

Figure 6:
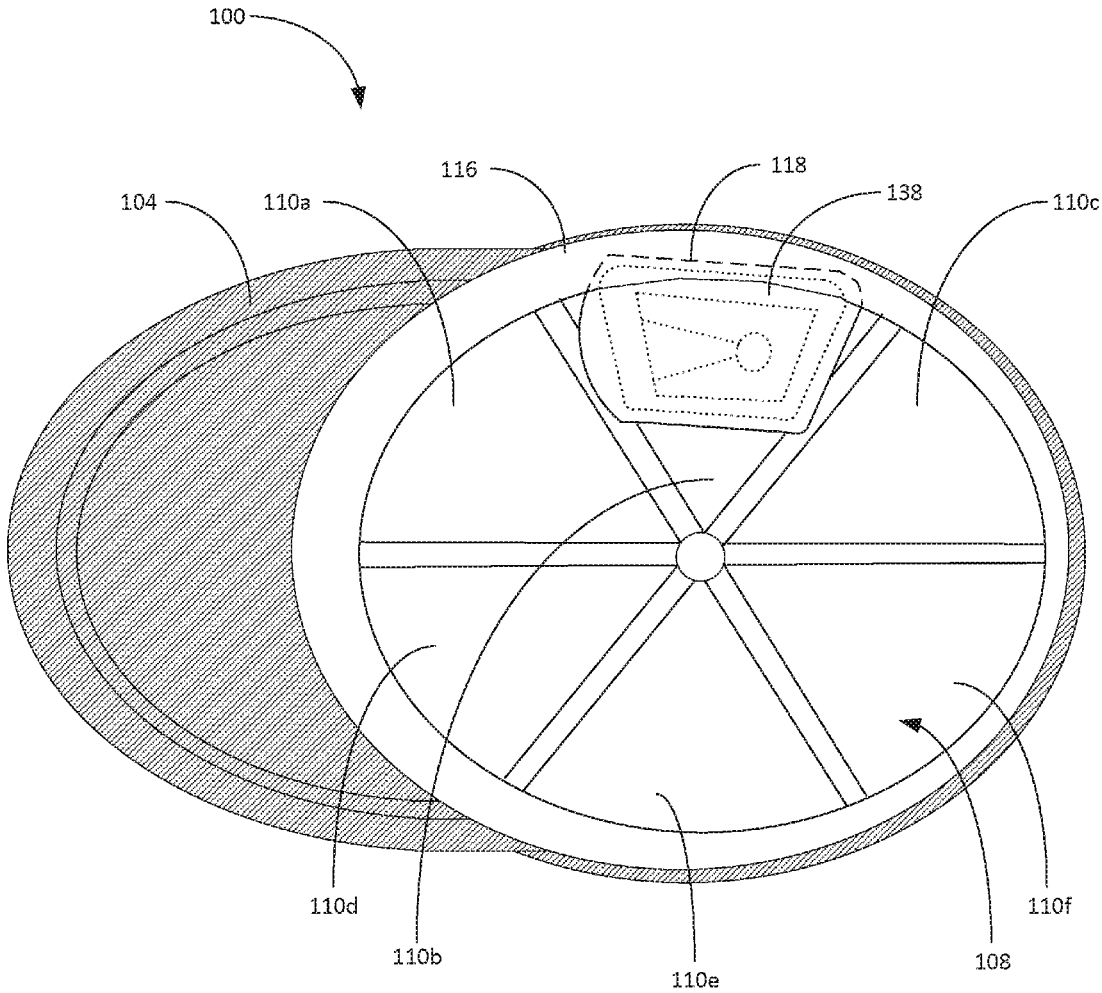
FIG. 6 depicts a bottom view of an identification storing headgear constructed in accordance with yet another exemplary embodiment.

The crown 102 of the headgear 100 has an outer surface 106 that is oriented away from the wearer and exposed to the environment and an inner surface 108 (depicted in FIG. 6) that is oriented toward the wearer when the headgear 100 is worn. As best illustrated in FIG. 6, the crown 102 may include a plurality of panels 110, where adjacent panels 110 are connected by seams 112. The crown 102 may include six panels 110 (e.g., a left front panel 110*a*, a left side panel 110*b*, a left rear panel 110*c*, a right front panel 110*d*, a right side panel 110*e*, and a right rear panel 110*f*).

The identification-storing headgear 100 further includes an identification holder 118 that is positioned against the inner surface 108 of the crown 102. As shown in FIG. 6, the identification holder 118 may be disposed between the sweatband 116 and the inner surface 108 of the crown 102. In embodiments where the identification holder 118 is positioned against a single panel 110 of the crown 102, the panel 110 may be specifically sized and shaped to accommodate the identification holder 118 behind it (see, e.g., FIGS. 1 and 2). The identification holder 118 may be permanently or releasably attached to the inner surface 108 of the crown 102. Suitable fasteners or attachment mechanisms for the identification holder 118 include any suitable chemical or mechanical fastener or attachment device or substance including without limitation, stitching, adhesive, permanent adhesive, fabric-compatible glue, tape, two-sided tape, fastener, clip, cleat, cutout, tab, snap, rivet, hog ring, or hook-and-loop fasteners.

Figure 3:
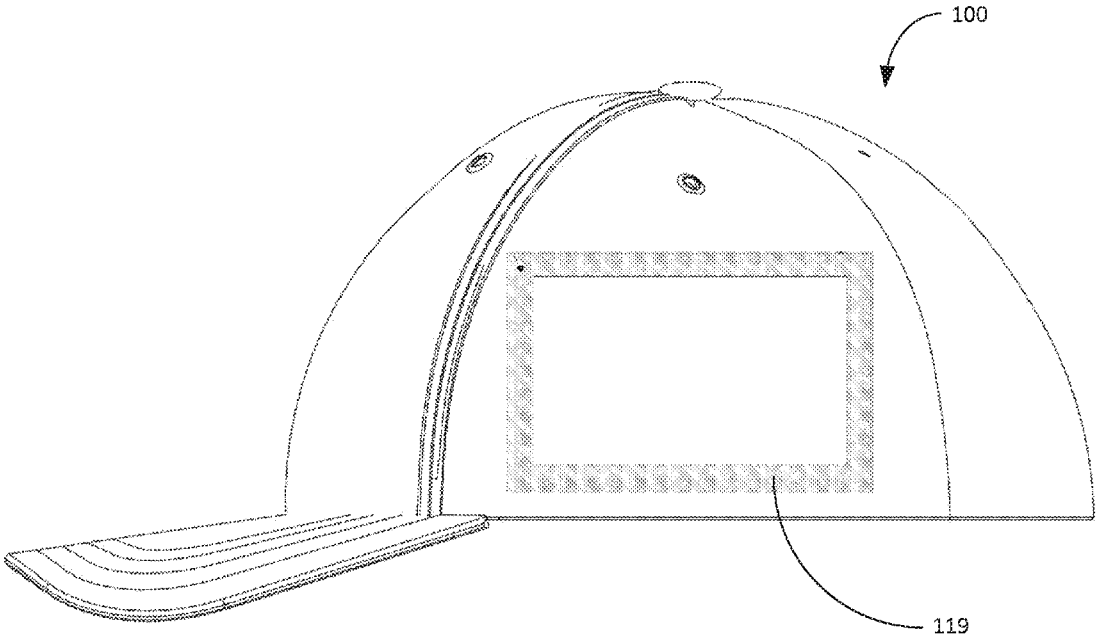
FIG. 3 presents a side view of the identification-storing headgear of FIG. 1 with stitching in accordance with an exemplary embodiment.

In one embodiment, the crown 102 and the identification holder 118 are stitched together using a double stitch 119 (shown in FIG. 3).

Figure 7A:
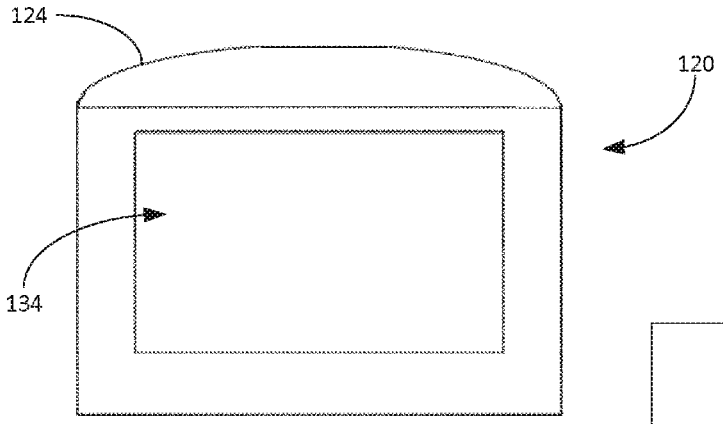
FIG. 7A depicts a front view of a front portion of an identification holder constructed in accordance with an exemplary embodiment.
Figure 7C:
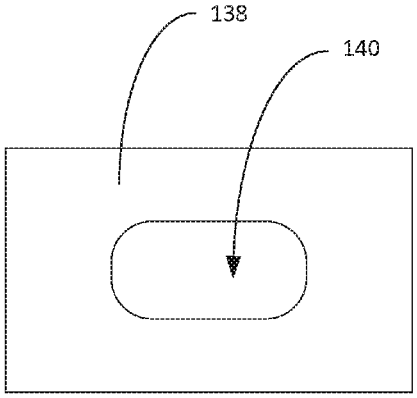
FIG. 7C depicts a front view of a window for an identification holder constructed in accordance with an exemplary embodiment.
Figure 7B:
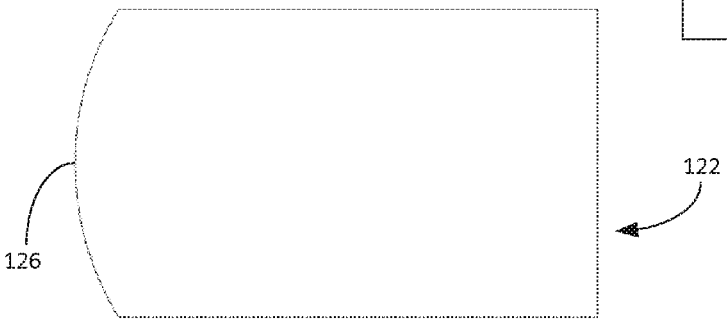
FIG. 7B depicts a front view of a back portion of an identification holder constructed in accordance with an exemplary embodiment.

The identification holder 118 includes a front portion 120 and a back portion 122. FIGS. 7A and 7B depict, respectively, exemplary shapes for the front portion 120 and back portion 122 of the identification holder 118. As shown, the front portion 120 may have a curved upper end 124 that promotes comfort by matching the curvature of the crown 102. The back portion 122 may have a curved side end 126. This curved end optionally tucks behind a stabilizer piece at the front of the headgear 100, thereby preventing the back portion 122 from poking the wearer when the headgear 100 is worn. The front and back portions 120, 122 may be constructed from materials such as plastics, metals, metal alloys, paperboard, latex rubber, fabrics (e.g., buckram fabric), or combinations of the same. Suitable plastics for the front and back portions 120, 122 of the identification holder 118 include, without limitation, high-density polyethylene, low-density polyethylene, terephthalate, polyethylene terephthalate, polyvinyl chloride, polycarbonate, polypropylene, acrylic, and nylon. In some embodiments, the back portion 122 of the identification holder 118 is covered with or constructed from a material that resembles the appearance of the outer surface 106 of the crown 102 in color, texture, or both. The back portion 122 is optionally covered with or made from the same material from which the crown 102 is constructed (e.g., buckram fabric).

Figure 8:
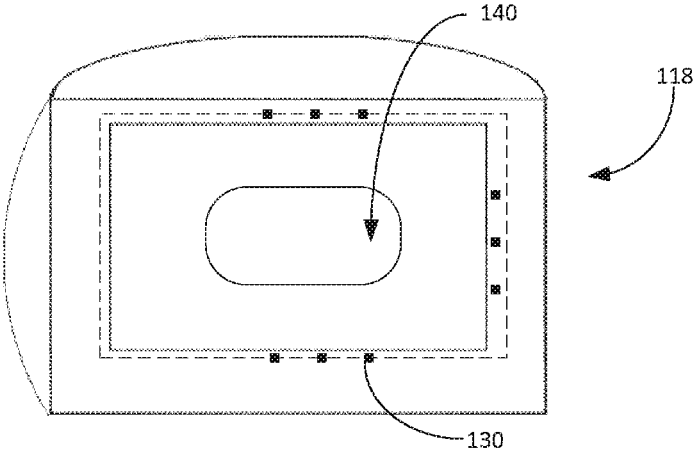
FIG. 8 depicts the front portion, back portion, and window of FIGS. 7A through 7C secured together with stitching according to an exemplary embodiment.

The front portion 120 and the back portion 122 of the identification holder 118 are secured to form an identification compartment 128 between the same. The front and back portions 120, 122 of the identification holder 118 may be attached together with the same fasteners or attachment mechanisms that secure the identification holder 118 to the inner surface 108 of the crown 102. In other embodiments, the front and back portions 120, 122 are independently secured with separate fasteners or attachment mechanisms before the identification holder 118 is attached to the crown 102. FIG. 8 depicts an exemplary non-limiting embodiment in which the front and back portions 120, 122 are secured by stitching 130 along three ends of the identification compartment 128 (i.e., the upper end, the lower end, and a side end).

Turning back to FIGS. 1 through 4, the front portion 120 of the identification holder 118 is positioned against the inner surface 108 of the crown 102. The identification compartment 128 of the identification holder 118 opens at an identification slit 132, which makes the identification compartment 128 accessible from the outer surface 106 of the crown 102. The curved side end 126 of the back portion 122 may be positioned proximate to the identification slit 132. As shown in FIGS. 1 and 2, the identification slit 132 may be positioned along a seam 112 between two panels 110 of the crown 102. Although FIGS. 1 and 2 depict the identification slit 132 along the seam 112 between the left front panel 110*a* and the left side panel 110*b* of a six-panel hat, it will be appreciated that the identification slit 132 may be suitably positioned along seams 112 at other positions. In other embodiments, as exemplified in FIG. 5, the identification slit 132 is present in the crown 102 at a position other than a seam 112. The sides of the identification slit 132 may be reinforced by stitching, binding tape, or other suitable support to reduce wear and fraying. Optionally, a closure 133 (depicted in FIG. 1A), such as a button or hook-and-loop fasteners, is positioned at the identification slit 132 and secures the open end of the identification compartment 128 in a closed position. The closure is not necessary for embodiments in which contents of the identification compartment 128 are held securely by frictional forces alone.

Figure 4:
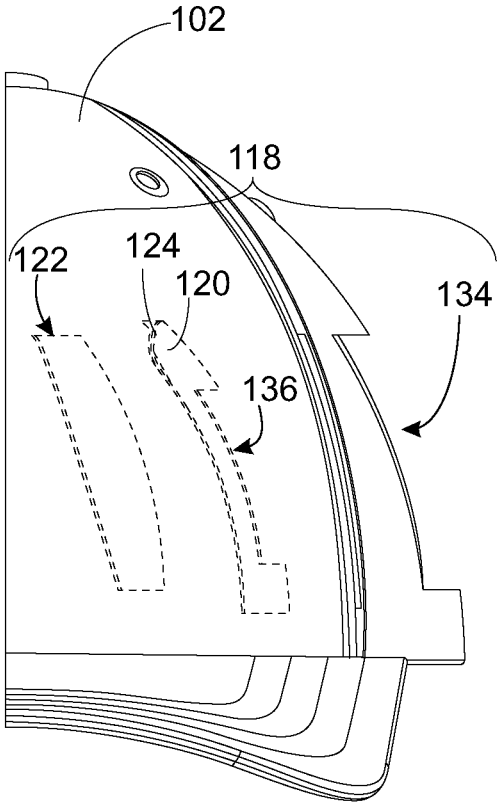
FIG. 4 presents an exploded partial front view of the identification-storing headgear of FIG. 1.
Figure 5:
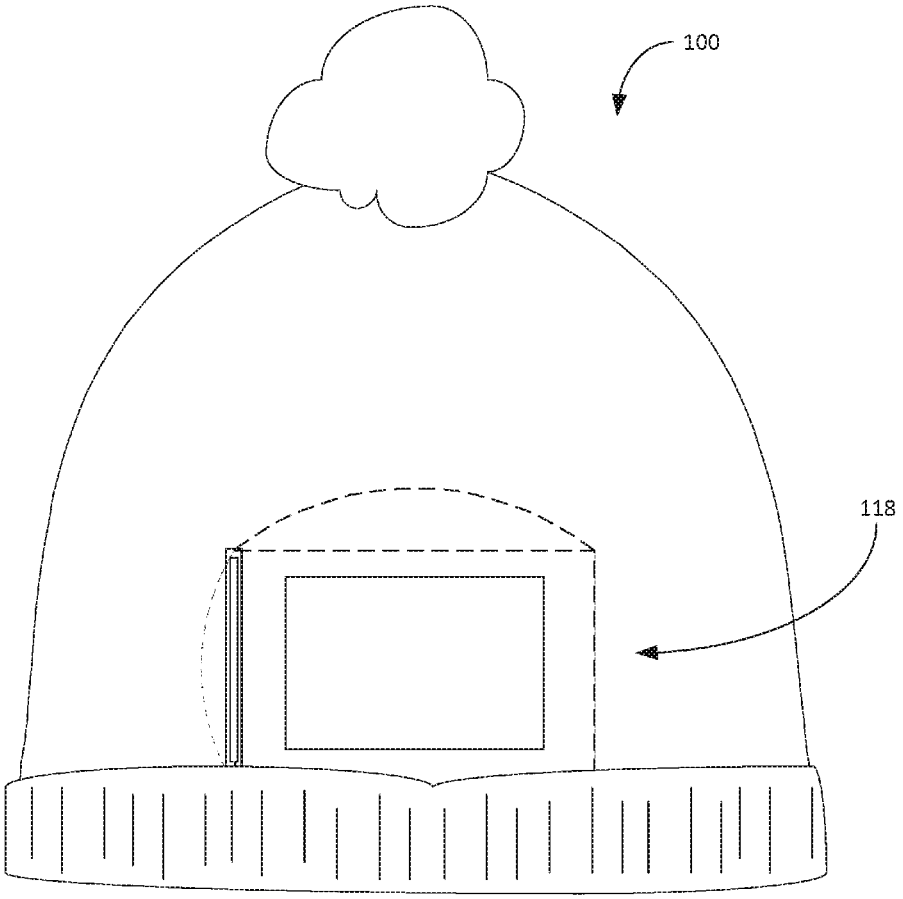
FIG. 5 presents a front view of an identification-storing headgear constructed in accordance with another exemplary embodiment.

As best illustrated in FIG. 4, in some embodiments, the crown 102 includes an identification viewing aperture 134, which allows the identification compartment 128, or a portion thereof, to be seen from the outer surface 106 of the headgear 100. The identification viewing aperture 134 corresponds to an opening 136 in the front portion 120 of the identification holder 118, thereby allowing the contents of the identification compartment 128 to be viewed from outside of the headgear 100. It will be appreciated that the identification viewing aperture 134 and the opening 136 in the front portion 120 may be sized and shaped to match the size and shape of an ID card or select portions thereof (e.g., a barcode, photograph, job title, name, position, clearance, company logo or other desirable company advertising, etc.). The identification holder 118 is positioned behind the identification viewing aperture 134 within the headgear 100 so that the opening 136 aligns with the identification viewing aperture 134. In this manner, the identification holder 118 acts as a "windowed pocket" that both secures and displays its contents (e.g., an ID card). In some embodiments, as shown in FIG. 7C and FIG. 8, a transparent window 138 is positioned between the identification viewing aperture 134 and the opening 136. This window 138 provides a barrier between contents in the identification compartment 128 and the open air. Where an ID card is stored in the identification compartment 128, the window 138 protects the ID from water damages, abrasions, etc. while allowing ID details to remain visible. In some embodiment, the window 138 is configured to not interfere with the signals from RFID, NFC, or other contactless communication systems. The window 138 optionally includes a thumb slot 140 (see FIG. 7C) that can be used for the wearer to contact the ID through the window and to facilitate removal of the ID from the identification compartment 128.

Figure 1B:
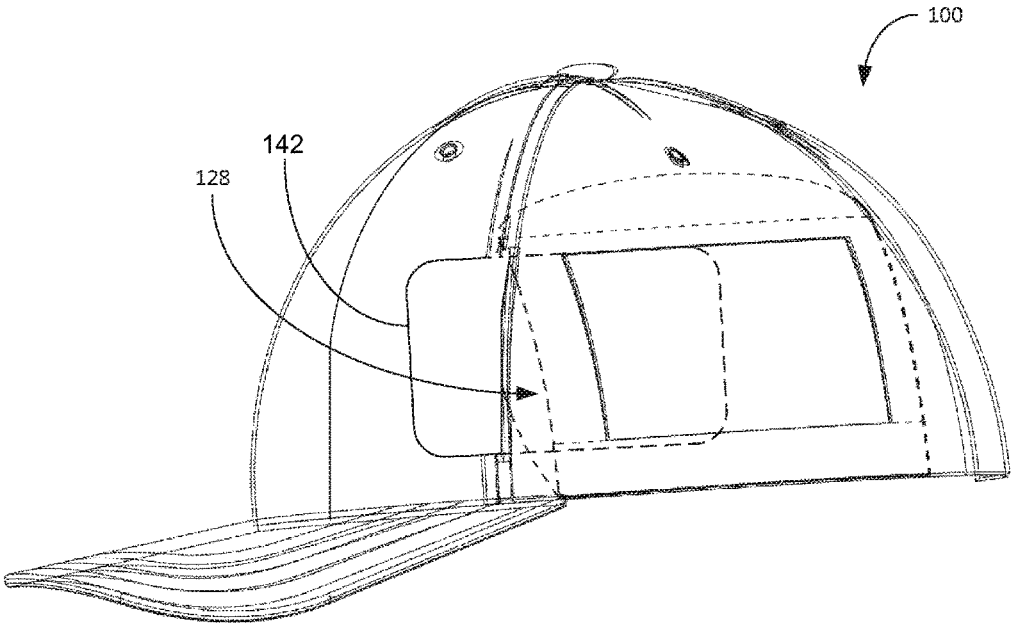
FIG. 1B presents the partial cutaway perspective view of FIG. 1A, where an identification card is partially disposed within an identification holder of the identification-storing headgear.
Figure 2:
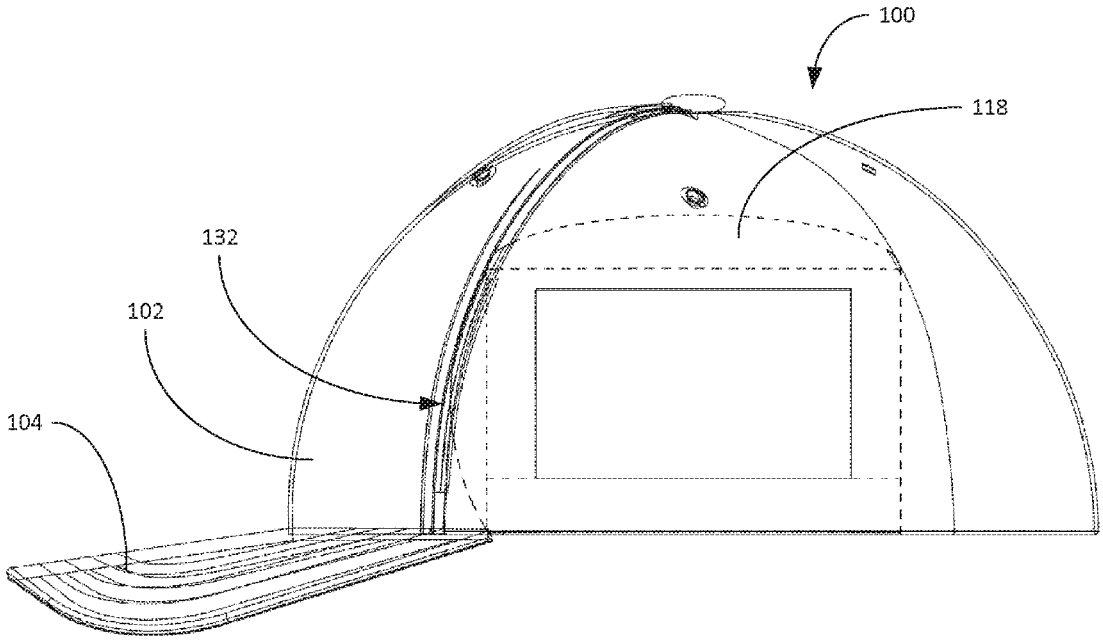
FIG. 2 presents a partial cutaway side view of the identification-storing headgear of FIG. 1.

As depicted in FIG. 1B, in an exemplary use, an ID card 142 may be inserted through the identification slit 132 into the identification compartment 128 for storage therein (see FIG. 1B). When the ID card 142 is disposed within the identification compartment 128, details on the ID 142 may be viewed through the opening 136 and identification viewing aperture 134. The ID card 142 may be used for contactless communication without removing the ID 142 from the identification compartment 128. For example, the headgear 100 may be removed from the wearer's head, placed against the appropriate contactless reader, and returned to the wearer's head, where the ID 142 remains secure, accessible, and easy to find.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein.

What is claimed is:

1. An identification-storing headgear, comprising:
- a crown comprising:
  - an outer surface adapted to be oriented away from a wearer;
  - an inner surface oriented toward the wearer when the headgear is worn;
  - an identification slit extending through the crown from the outer surface to the inner surface; and
  - an identification holder comprising:
    - a front portion positioned against the inner surface of the crown; and
    - a back portion that is secured to the front portion to form an identification compartment, wherein the identification compartment opens at the identification slit such that the identification compartment is accessible from the outer surface of the crown via the identification slit.

2. The identification-storing headgear of claim 1, wherein the crown further comprises a plurality of panels.

3. The identification-storing headgear of claim 2, wherein the identification slit is positioned along a seam between two of the plurality of panels.

4. The identification-storing headgear of claim 3, wherein the crown further comprises an identification viewing aperture, wherein the identification holder is positioned behind the identification viewing aperture.

5. The identification-storing headgear of claim 4, wherein the identification viewing aperture is disposed through one of the plurality of panels that is adjacent to the identification slit.

6. The identification-storing headgear of claim 5, wherein the front portion comprises an opening that corresponds to the identification viewing aperture.

7. The identification-storing headgear of claim 6, wherein a transparent window is positioned between the identification viewing aperture and the opening.

8. The identification-storing headgear of claim 7, wherein the transparent window is configured to not interfere with transmission of contactless communication signals between the identification compartment and a contactless reader.

9. The identification-storing headgear of claim 7, wherein the transparent window includes a thumb slot.

10. The identification-storing headgear of claim 1, wherein the crown further comprises a sweatband, wherein the identification holder is disposed between the sweatband and the inner surface.

11. The identification-storing headgear of claim 1, wherein the front portion has a curved upper end.

12. The identification-storing headgear of claim 1, wherein the back portion has a curved side end positioned proximate to the identification slit.

13. The identification-storing headgear of claim 1, further comprising a closure positioned at the identification slit.

14. The identification-storing headgear of claim 13, wherein the closure comprises a button.

15. The identification-storing headgear of claim 13, wherein the closure comprises hook-and-loop fasteners.

16. The identification-storing headgear of claim 1, wherein the back portion comprises high density polyethylene.

17. The identification-storing headgear of claim 1, wherein the front portion comprises high density polyethylene.

18. The identification-storing headgear of claim 1, wherein at least one of the front portion and the back portion of the identification holder comprises buckram fabric.

19. The identification-storing headgear of claim 1, wherein the back portion of the identification holder is covered with or constructed from a material that resembles an appearance of the outer surface of the crown in at least one of color and texture.

20. The identification-storing headgear of claim 1, wherein the identification holder is attached to the inner surface of the crown by a double stitch.

21. A headgear comprising:

a crown comprising:

an outer surface adapted to be oriented away from a wearer;

an inner surface oriented toward the wearer when the headgear is worn;

an identification slit extending through the crown from the outer surface to the inner surface; and an identification viewing aperture; and an identification holder positioned behind the identification viewing aperture, wherein the identification holder comprises:

a front portion positioned against the inner surface of the crown; and a back portion that is secured to the front portion to form an identification compartment, wherein the identification compartment opens at the identification slit such that the identification compartment is accessible from the outer surface of the crown via the identification slit.

22. The headgear of claim 21, wherein the crown further comprises six panels, wherein adjacent panels of the six panels are attached by seams.

23. The headgear of claim 22, wherein the identification slit is positioned along a seam that attaches a front panel from the six panels and a side panel from the six panels.

24. The headgear of claim 23, wherein the identification viewing aperture is disposed through the side panel that is adjacent to the identification slit.

25. The headgear of claim 24, wherein the crown further comprises a sweatband, wherein the identification holder is disposed between the sweatband and the inner surface.

26. The headgear of claim 22, wherein the identification slit is positioned along a seam that attaches a left front panel of the six panels and a left side panel of the six panels.

27. The headgear of claim 21, wherein the back portion comprises high density polyethylene and the front portion comprises high density polyethylene.

28. A headgear, comprising:

a crown comprising:

an outer surface adapted to be oriented away from a wearer;

an inner surface oriented toward the wearer when the headgear is worn;

a sweatband secured to the inner surface;

an identification slit extending through the crown from the outer surface to the inner surface; and an identification viewing aperture; and an identification holder positioned behind the identification viewing aperture between the inner surface and the sweatband, wherein the identification holder comprises:

a front portion positioned against the inner surface of the crown; and a back portion that is secured to the front portion to form an identification compartment, wherein the identification compartment opens at the identification slit such that the identification compartment is accessible from the outer surface of the crown via the identification slit.

* * * * *